United States Patent [19]

Fiorentino

[11] 3,983,730

[45] Oct. 5, 1976

[54] METHOD OF HYDROSTATIC EXTRUSION

[75] Inventor: Robert J. Fiorentino, Worthington, Ohio

[73] Assignee: Battelle Memorial Institute, Columbus, Ohio

[22] Filed: Feb. 12, 1976

[21] Appl. No.: 657,668

Related U.S. Application Data

[63] Continuation-in-part of Ser. No. 172,039, Aug. 16, 1971, abandoned.

[52] U.S. Cl. ..... 72/46; 72/60; 72/DIG. 31

[51] Int. Cl.[2] ..... B21B 45/00

[58] Field of Search ..... 72/45, 46, 41, 42, 60, 72/352, 358, 268, DIG. 31; 29/421 R

[56] References Cited

UNITED STATES PATENTS

| | | | |
|---|---|---|---|
| 3,072,251 | 1/1963 | Sauve | 72/42 |
| 3,345,842 | 10/1967 | Richards | 72/46 |
| 3,382,691 | 5/1968 | Green | 72/60 |
| 3,451,240 | 6/1969 | Sauve | 72/60 |
| 3,580,019 | 5/1971 | Beresnev et al. | 72/47 |
| 3,677,048 | 7/1972 | Fuchs, Jr. | 72/60 |

FOREIGN PATENTS OR APPLICATIONS

| | | | |
|---|---|---|---|
| 1,043,834 | 9/1966 | United Kingdom | 72/266 |

OTHER PUBLICATIONS

*Bulleid Memorial Lectures*, 1965, vol. IIIB, "Recent Developments in Cold Forming," H. L. Pugh, pp. (3)29–3(34).

*Primary Examiner*—C.W. Lanham
*Assistant Examiner*—James R. Duzan
*Attorney, Agent, or Firm*—Philip M. Dunson; Stephen L. Peterson

[57] ABSTRACT

A method of lubricating a metal billet during an extrusion process where at least two lubrication systems are used. Each of the lubrication systems has a different viscosity and the systems can be of the same material or two different material compositions. A solid-lubrication system immediately adjacent to the billet functions primarily as a die lubricant while a liquid-lubrication system immediately adjacent the container is pressurized by the advance of a sealed ram in contact with the billet. The liquid lubrication system forms a thin film of pressurized liquid lubricant adjacent the container wall and substantially reduces or virtually eliminates friction thereupon during extrusion of the billet under hydrostatic or quasi-hydrostatic conditions.

9 Claims, 1 Drawing Figure

INVENTOR.
R.J. FIORENTINO

BY Gray, Mason & Lemon

ATTORNEYS

METHOD OF HYDROSTATIC EXTRUSION

CROSS REFERENCE TO RELATED APPLICATION

This application is a continuation in part of application Ser. No. 172,039, filed Aug. 16, 1971, now abandoned.

BACKGROUND OF THE INVENTION

The invention as herein disclosed relates to the art of extrusion and extrusion lubrication where a metal billet is forced by the application of high pressure through an orifice of cross-sectional area less than that of the original billet. The invention provides a means of reducing the required capacity of the high-pressure source by eliminating or substantially reducing the applied pressure required to overcome container wall friction obtained in a normal or conventional extrusion process. The invention also has the advantage of providing hydrostatic or quasi-hydrostatic extrusion conditions without the attendant complexities of equipment and processes known in the prior art.

Of significant importance in the prior art is the concept known as hydrostatic extrusion where a pressurized fluid medium exerts the force that extrudes the billet through the die orifice. The advancing ram has the function of maintaining a high pressure within the fluid rather than advancing the billet by bearing on the billet end opposite the extrusion orifice. As currently practiced by those skilled in the art, considerable extrusion cycle time is lost to fluid handling, i.e., fluid injection, compression, decompression, and ejection. This necessarily results in production rates (extrusions per unit time) significantly lower than those normally achieved by conventional extrusion methods.

One of the advantages of the present invention is to allow production rates equal or close to those achieved by conventional extrusion in either hydraulic or mechanical presses while still retaining the well-known advantages of plain hydrostatic extrusion.

Also of importance in the prior art is the concept of billet-augmented hydrostatic extrusion wherein the advancing ram maintains contact with the billet during extrusion hereinafter called billet-augmented extrusion. In the method of U.S. Pat. No. 3,382,691, Green, the main purpose of the billet-augmentation pressure is to maintain better billet control than that obtained in plain hydrostatic extrusion, particularly during a condition known as stick-slip where the billet moves intermittently rather than at a constant speed. The billet-augmentation pressure exerted by the ram is carefully controlled in relation to the fluid pressure so that the billet does not plastically upset or bulge into the substantial annular gap maintained between the billet and container. To maintain constant fluid and billet-augmentation pressure levels as the billet extrudes, the excess fluid volume in the billet container is bled off continuously back into a separate hydrostatic pressure container via an axial hole in the extrusion ram. The equipment is necessarily more complex and costly than that for plain hydrostatic extrusion at a comparable fluid pressure level. Also, the production rate are relatively low because of the fluid-handling problem previously cited for plain hydrostatic extrusion.

It is the object of the present invention to improve the hydrostatic extrusion process by using special techniques and procedures which simplify the operation greatly over that currently practiced by those skilled in the art.

The process according to the present invention consists of precoating the billet with two lubrication systems. Each lubrication system may consist of one substance, or several substances together, which perform the intended function. A solid-lubrication system adherent to the billet functions primarily as a die lubricant. A liquid-lubrication system overlays the solid lubrication system and functions primarily as the container lubricant, i.e., in the same way as the hydrostatic medium functions in plain hydrostatic extrusion or billet-augmented hydrostatic extrusion. The liquid lubrication layer is pressurized by the advance of a sealed ram. The presence of a thin film of pressurized liquid lubricant between and the billet and the container wall substantially reduces or virtually eliminates container wall friction during billet extrusion. The radial clearance between the billet and container is preferably kept to the minimum needed to still minimize container wall friction by the presence of a thin pressurized liquid film. Also, only the minimum amount of liquid lubricant is used between the billet and ram at the start in order to allow enough liquid pressurization prior to extrusion to minimize friction. By keeping the volume of liquid lubrication to a minimum, the billets can be precoated with this system by various methods. Precoating of the billets with, in effect, the hydrostatic medium greatly increases the production rate capability of the hydrostatic extrusion process as currently practiced by those skilled in the art.

Another feature of the invention is that the ram is allowed to contact the billet just prior to and during extrusion. This aspect is similar to billet-augmented hydrostatic extrusion. However, by keeping the radial clearance between the billet and container to a minimum and with proper lubrication systems and tooling design, it is possible to achieve the benefits of billet-augmented hydrostatic extrusion without the attendant disadvantages of complex and costly equipment. The preferred radial clearance utilized with the present invention is somewhat dependent on the billet size. For billets of diameters between 1.0 and 4.0 inches this clearance can be approximately 0.010 inch. Smaller diameter billets may utilize a clearance less than 0.010 inch down to a minimum clearance of a few mils. With the exception of these smaller billets the clearance is normally less than 1 percent of the nominal diameter of the billet. In the present invention, the billet may upset but it cannot excessively because of the small radial clearance that is used. Also, the small volume of liquid lubrication system used eliminates the need for bleeding off the liquid lubricant during billet extrusion, as disclosed by the previously cited Green patent concerning billet-augmented hydrostatic extrusion.

Thus, while the preferred range of radial clearance is normally not greater than about 1 percent of the nominal diameter of the billet, larger radial clearances up to about 2 percent are also useful. However, as the clearance is increased much beyond this level, all the problems attendant to handling and pressurizing larger amounts of fluid increase. Among these problems are less billet control because of greater stored energy in the fluid, lower production rates, greater hazards of fire and air pollution when fluids are used at elevated temperature, and higher fluid expense. In addition, larger radial clearances lower the billet volume for a given container size, and this increases the extrusion cost per unit volume of product produced for each push.

DETAILED DESCRIPTION OF THE DRAWING

Figure 1:
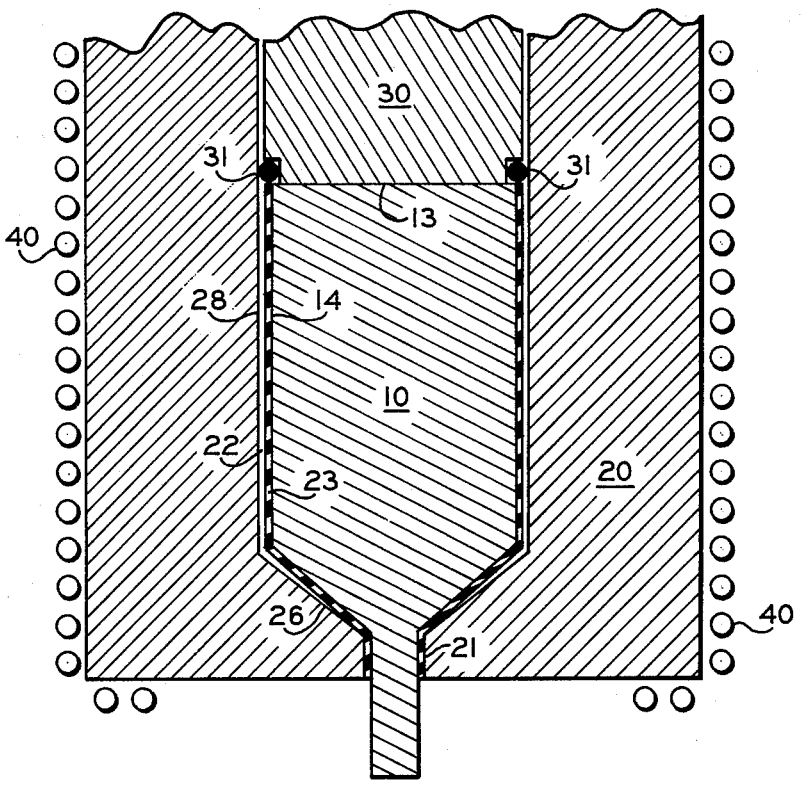
FIG. 1 is a semi-schematic cross-sectional view of an extrusion apparatus showing two lubrication systems within the annular gap between the billet and the container.

FIG. 1 illustrates an extrusion apparatus consisting of a billet 10 within a container 20 having a ram 30 disposed to force the billet 10 through an orifice 21. The ram 30, however, has a seal 31 that is disposed to prevent or minimize any liquid lubricant 22 or solid lubricant 23 from passing the forward face of the ram 30 when the ram advances within the container 20. The billet 10 is lubricated by two lubrication systems, the liquid lubricant 22, and the solid lubricant 23. These lubricants may be different materials such as a fluoroplastic and castor oil or they can be the same material such as solid wax with a layer of that wax adjacent to the container 20 heated by the heating elements 40 to form a film of liquid lubricant 22.

It is the function of the solid lubricant 23 to remain substantially on the surface 14 of the billet 10 to provide lubrication where metal deformation creates the possibility of billet-to-container contact. This is known to occur most frequently where metal deformation is most severe and where the billet has a tendency to upset. The tapered die section 26 of the container 20 and the orifice 21 are two such areas and it is one of the functions of the solid lubricant 23 to minimize contact in these areas; however, the presence of the solid lubricant 23 along the entire surface 14 of the billet 10 also prevents or minimizes to a very large extent metal-to-metal contact at any area on the container wall 28. Moreover, the normal ability of the solid lubricant 23 to prevent metal-to-metal contact in conventional extrusion processes is improved in the present invention due to the presence of the liquid lubricant 22 which is highly pressurized within the annular gap between the container surface 28 and the solid lubricant 23.

The layer of liquid lubricant 22 has the primary function of reducing friction along the container wall 28. Also, by providing a gap between the billet nose taper and die entry surface, the liquid lubricant helps to reduce friction within the tapered die section. The lubrication of the container wall 28 by the liquid lubricant 22 enables the energy normally lost to friction to be applied to the billet. The elimination of this container friction allows the length/diameter ratio of the billet to be increased without necessitating a significant increase in the force applied to the billet.

The liquid lubricant is also used to transmit the high pressure developed when the container volume is reduced by the advancing sealed ram 30. These pressures can be manipulated by altering the amount of liquid lubricant present initially within the container. If it is required to operate at high liquid lubricant pressures, a space will be left between the billet 10 and the ram 30 at 13 where excess liquid lubricant will be placed before starting the extrusion process. When the billet 10 is forced into the die 26 and effectively sealing the orifice 21, the pressure in this liquid layer will increase as the container volume decreases. If this excess fluid volume is large, the ram 30 will not contact the billet 10 at 13 before or during extrusion. The present invention is normally not utilized in that manner and the initiation of the extrusion process is normally set up to occur when the advancing ram 30 has compressed the liquid lubricant 22 to an extent where the ram 30 and the billet 10 are in contact and the motion of the billet 10 is due to the pressure exerted at 13 by the ram 30. The initiation of billet extrusion by ram contact has the added advantage of eliminating or minimizing the high-pressure transient peaks associated with the start of a hydrostatic extrusion process with marginal or poor billet lubrication in the die region. It is possible that at some point during the extrusion process, the change in container volume has been large enough that the pressure in the liquid lubricant 22 is equal to the pressure exerted by the ram 30 and at that point a film of liquid lubricant 22 will form between the billet 10 and the ram 30 at 13. This may not always occur but it does not present a problem since the billet will be advanced within the container in substantially the same manner as if in contact with the ram face at 13.

It should be understood that the use of the term "ram" or "ram face" does not restrict the present invention from the use of functional equivalents. The seal 31 can also be incorporated on a dummy block with such a block contacting the billet 10 at 13.

It is well within the capability of those skilled in the art of metal extrusion to manipulate the liquid lubricant pressure developed during the process without excessive experimentation.

The present invention also has the advantage of extruding the billet at essentially a constant extrusion pressure substantially independent of the length/diameter ratio. Conventional extrusion processes begin with a maximum force at the initiation of extrusion with that force diminishing during the process in proportion to the length of the unextruded portion of the billet. This gradual reduction in the extrusion pressure in conventional processes is due to the reduction of container friction as the unextruded portion of the billet becomes shorter. The present invention virtually eliminates this container friction and allows billets of large length-to-diameter ratios to be extruded at significantly lower pressures than used in conventional processes. Conventional extrusion methods are economical and produce good quality extrusions but are limited generally to billet length/diameter ratios less than about 3. However, as the length/diameter ratio is increased, the extrusion pressure must also be increased and, at some point, the advantage in productivity by using long billets is outweighed by the required capacity of the press used to exert the extrusion process.

The present invention substantially eliminates the dependency of the extrusion pressure on the length-/diameter ratio of the billet. In eliminating this dependence, the present invention allows the extrusion of a larger range of billet length-to-diameter ratios, thereby increasing the productivity of a given extrusion press.

The present invention is operable in several configurations depending upon the type of lubricant used. When the solid lubricant and the liquid are of different material compositions, the process is carried out as previously described. Materials used conventionally as solid lubricants are applicable to the present invention and can be comprised of metallic plating on the billet, chemical compounds, or elements adhering to the billet. Specific examples of operable solid materials include: copper plating, zinc phosphate and stearate soap, and fluoroplastics. While these materials have demonstrated adequate lubrication properties under high-pressure sliding contact, they are not to be construed as a limitation of the invention since any solid possessing lubricating properties can be used. The liquid lubricant adjacent the container wall may consist of any liquid compatible with the solid lubricant and the container. The process has been successful with conventional petroleum oils, vegetable oils, synthetic fluids, and water. A variation on this method would be the coating of a tenacious solid lubricant on the billet that can withstand elevated temperatures. Prior to the initiation of the extrusion process a solid lubricant that will melt at elevated temperatures is coated on the interior of the container. The billet is heated to a temperature disposed to melt the lubricant coating the container. Upon insertion of the hot coated billet into the lubricated container the heat from the billet melts the lubricant coating the container and a film of liquid lubricant adjacent the container is formed. The sealed ram is then advanced within the container and the extrusion process carried out.

The present invention is also operable where the solid lubricant and the liquid lubricant are the same material, with the viscosity altered by the temperature of the material. Using the invention in this manner entails coating the billet (prior to insertion into the container) with a layer of material being solid at the billet temperature and heating the container walls to a temperature that will melt or significantly lower the viscosity of a portion of the material in contact with the container forming a liquid layer. This provides a two-lubricant system, as illustrated in the figure, using a single material as both lubricants. The material used in this manner, when a solid, must provide adequate lubrication of the billet particularly as it passes through the die and extrusion orifice by preventing or minimizing metal-to-metal contact. Materials that have demonstrated the ability to operate in the afore-mentioned manner include: hydrogenated vegetable oils, heavy petroleum products, waxes, and ice.

The material used as the lubricant is not restricted to the above examples and any material having adequate lubrication properties in both a solid and liquid state will be operable with the only limitation being that the temperature of the change of state from solid to liquid being within a feasible range. The use of materials having no change of state but rather a continuous change of viscosity with temperature is also operable with the present invention with the only limitation on such lubricants being that their viscosity may be altered with temperature from a solid to a less viscous state approximating the properties of a liquid.

The proper temperature to heat the container or the billet and create a liquid lubricant layer will depend on the material used for the lubricants, and simple experimentation by those skilled in the art can readily define the optimum temperature for any given process.

It should be understood that the use of the terms "liquid" and "solid" designate those properties under actual extrusion conditions rather than at ambient temperature and atmospheric pressure.

It should also be understood that the use of the term "container 20" also includes the die portion 26 whether or not such a section is contiguous with the container wall 28. Therefore when it is stated "the container 20 is heated," this also means the die section 26 and the orifice 21 are also heated.

it should be further understood that those skilled in the art may alter or modify the concepts herein disclosed without departing from the spirit and scope of the invention as herein disclosed. For example, there may be more than two lubrication systems or the final product need not be a simple rod produced from a cylindrical billet as shown in the figure. It is well within the ability of those skilled in the art to adapt the present invention to the production of tubular products or those products having complex cross sections and still be within the scope of the appended claims.

I claim

1. A method of extruding a billet through a die with an advancing ram comprising precoating the billet with an adherent solid material primarily disposed to lubricate the billet while it passes through the die, providing a layer of liquid material between the coated billet and an extrusion container within an annular gap between the billet and the container of not greater than about 2 percent of the nominal diameter of the billet, providing seals within the container disposed to retain the liquid material within the container and including a seal bearing on the ram, pressurizing the liquid material within the annular gap by advancing the sealed ram within the container with the pressure in the liquid material determined by the amount of the liquid material initially within the container, initiating extrusion of the billet by substantially contacting the billet with the ram, and advancing the ram further into the container forcing the billet through the die while maintaining pressure on the liquid material within the container.

2. A method as in claim 1, wherein extrusion of the billet is initiated with a film of the liquid material between the ram and the billet.

3. A method as in claim 1, that includes providing a gap between the billet nose taper and the die entry surface.

4. A method as in claim 1, wherein the annular gap is not greater than about 1 percent of the nominal diameter of the billet.

5. A method as in claim 1, wherein the solid material and the liquid material are of the same chemical composition, and the container is heated to change the state of the material in contact with it, thereby creating the layer of liquid lubricant in contact with the container at the inner surface of the container.

6. A method as in claim 5, wherein the solid material comprises essentially hydrogenated castor oil, heavy petroleum grease, wax, or ice.

7. A method as in claim 1, wherein the solid material and the liquid material differ in chemical composition and in state or viscosity.

8. A method as in claim 7, wherein the solid material is selected from the class of materials defined as metals, elemental materials, organic compounds, or inorganic compounds, and the liquid material is selected from the class of materials defined as vegetable oils, petroleum oils, or liquid inorganic compounds.

9. A method as in claim 7, wherein the extrusion includes precoating the billet with a tenacious solid lubricating material capable of withstanding exposure to elevated temperature, coating the interior surface of an extrusion container with a second solid lubricant that changes to liquid form upon the application of heat, heating the billet above a temperature disposed to change the second solid lubricant to a liquid, and inserting the heated billet within the container and thereby forming a layer of liquid lubricant adjacent the container from the second solid lubricant.

* * * * *